US005778773A

United States Patent [19]

Clark

[11] Patent Number: 5,778,773

[45] Date of Patent: Jul. 14, 1998

[54] TIDY CAN KEEPER

[76] Inventor: Carolyn M. Clark, 2104 S. Park, Oak Grove, Mo. 64075

[21] Appl. No.: 832,107

[22] Filed: Apr. 3, 1997

[51] Int. Cl.[6] ..... B30B 9/32

[52] U.S. Cl. ..... 100/218; 100/288; 100/902

[58] Field of Search ..... 100/218, 255, 100/288, 902

[56] References Cited

U.S. PATENT DOCUMENTS

| | | | |
|---|---|---|---|
| 969,720 | 9/1910 | Pickett | 100/902 |
| 1,998,263 | 4/1935 | Townsend | 100/288 |
| 3,374,730 | 3/1968 | Cain | 100/902 |
| 3,768,398 | 10/1973 | Ullman, Jr. | 100/255 |
| 4,108,065 | 8/1978 | Unger . | |
| 4,240,341 | 12/1980 | Whipple et al. . | |
| 4,414,891 | 11/1983 | Kitzman | 100/288 |
| 4,432,278 | 2/1984 | Skipworth . | |
| 4,463,670 | 8/1984 | Thomas . | |

FOREIGN PATENT DOCUMENTS

| | | | |
|---|---|---|---|
| 0515835 | 12/1992 | European Pat. Off. | 100/902 |
| 5-245698 | 9/1993 | Japan | 100/902 |
| 6-87097 | 3/1994 | Japan | 100/902 |
| 2239784 | 7/1991 | United Kingdom | 100/902 |

*Primary Examiner*—Stephen F. Gerrity
*Attorney, Agent, or Firm*—Patent & Trademark Services; Thomas Zack; Joseph H. McGlynn

[57] ABSTRACT

A can crusher that is attachable to a trash or recycle container. The crusher has a movable vice between which the can to be crushed is placed. An extending upright handle is manually operated to move the vice and crush the can which then exits to the container via a normally trap door and a protective chute. Two gear racks with lower camming members open the trap door as the vice crushes the can. After, the crushing operation is completed the handle may be manually returned to its original position to reclose the normally closed trap door and permit to crushing of additional cans placed in the vice.

4 Claims, 2 Drawing Sheets

TIDY CAN KEEPER

BACKGROUND OF THE INVENTION

Over the last several years municipalities throughout the United States have taken to the massive recycling of reusable items such as paper, plastic, glass bottles, tin and aluminum cans. Before that time these items were simply thrown out with the trash and placed in landfills where many remain to this day.

Whether cans are recycled for their future material use or simply thrown out as trash, their sheer volume within the trash container is such that many persons try to crush them before disposing of them. This can be done either manually, such as by hand with some effort or by using a power operated or manual compactor. The present invention relates to one such manually operable can crusher wherein the cans are crushed within a container and maintained in a sealed container thereafter. In the crushing operation a lower normally closed trap door is opened by actuating a handle and then depositing the crushed can into a container. Detailed structure to accomplish these functions are described in the material to follow.

DESCRIPTION OF THE PRIOR ART

Can compactors or crushers are known in the prior art. For example, in U.S. Pat. No. 4,108,065 to Unger the compactor has a sloped guide such that a row of cans roll into a ram. In the Whipple et al. reference (U.S. Pat. No. 4,240,341) an electrically operated can crusher is disclosed which performs two crushing operations on each stroke of a ram. The Shipworth patent (U.S. Pat. No. 4,432,278) describes a can crusher which longitudinally flattens the cans to expel any liquid remaining in them. And in can crusher of U.S. Pat. No. 4,463,670 to Thomas there is an ejector lever to remove the crushed cans. The present invention contrasts with these inventions and the known prior art by providing for a can crusher attached to a lid of a container with a mechanism connected that opens and permits the closing of a door to the container after the can is crushed as more further set forth in this specification.

SUMMARY OF THE INVENTION

This invention relates to a can crusher that is attachable to a container. The crusher has a vice between which the can to be crushed is placed. An extending upright handle is manually operated to move the vice and crush the can after which they are deposited to the container. After, the crushing operation is completed the handle can be returned to its original position to permit the crushing of another can placed in the vice.

It is the primary object of the present invention to provide for an improved apparatus to crush cans.

Another object is to provide for a can crusher whose operating handle can be reset after the crushing operation is completed to permit its reuse.

These and other objects and advantages of the present invention will become apparent to readers from a consideration of the ensuing description and the accompanying drawings.

DESCRIPTION OF THE PREFERRED EMBODIMENT

Figure 1:
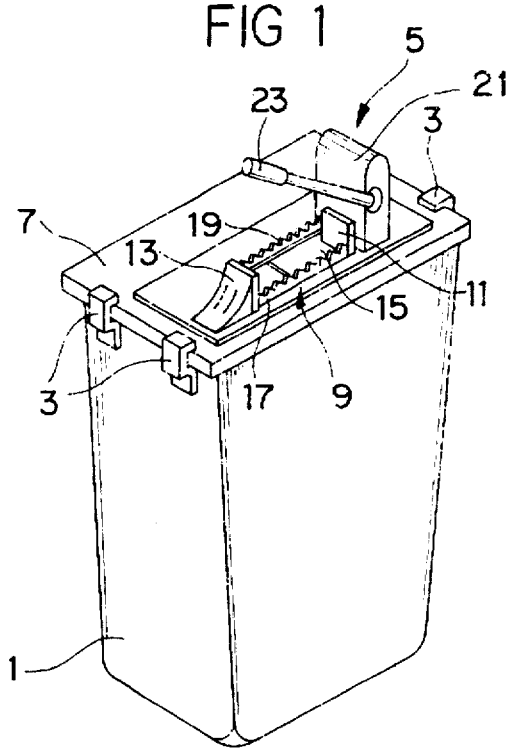
FIG. 1 is a side perspective view of the invention's preferred embodiment mounted on a container.

FIG. 1 is a side perspective view of the invention's preferred embodiment mounted on a lower conventional plastic trash container 1 such as those commonly found in the home with its top removed. Four spaced mounting clips 3 (three fully shown) mount the can crusher 5 to the top of the container by holding on to the crusher's flat support plate base 7 and the opposite sides of the underlying container's upper lid edge.

The can crusher has a vice like member 9 with a stationary anvil element 11 and a movable base 13 between which the can to be crushed is placed. Forming part of the surface on which such cans are placed is a trap door 15 which can deposit crushed cans, when opened, to the underlying container 1. Extending the side of the crushing surface area are two linear rack toothed gear segments 17 and 19. Located adjacent the anvil element 11 is a housing 21 which contains appropriate interrelated gears that will operate the vice 9 when upright handle 23 is pulled down in the direction of the arrow. Once the crushing operation is completed and the crushed can deposited in the underlying container, the depressed handle is returned to the shown position for crushing the next can.

Figure 2:
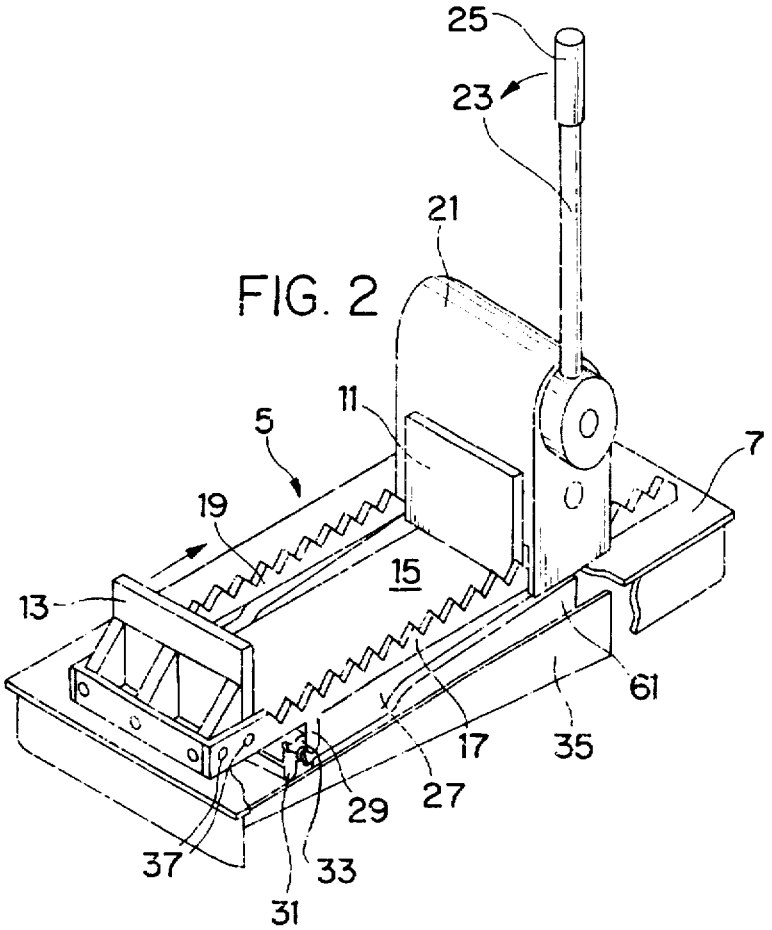
FIG. 2 is a side perspective view of the FIG. 1 can crusher showing details of its construction.

FIG. 2 is a side perspective view of the FIG. 1 can crusher showing details of its construction. Normally a user grips the rubber or soft plastic cushioned hand grip 25 to move the elongated straight lever 23 in a downward arcuate manner as shown by the direction of the arrow. Appropriate gearing then moves the front movable element 13 towards the anvil element 11 to crush a can lying lengthwise there between on the trap door surface 15. The lower trap door lid 27 is released to lower its end nearest the movable element 13 and open the trap door thus allowing the crushed can to fall under the influence of gravity into the container 1. Also show in this figure are the trap door cam 29, linear rack gear, the hinge 31 for the trap door lid, the return spring 33 for trap door, and the lower sloped trap door lid protector chute 35.

The trap door is spring loaded to bias the door into a normally closed position. Once the movable element linearly is moved towards its associated anvil vice member 11, the door opens until the underlying door has a slope of about 20 degrees from the horizontal when fully dropped or opened. A protective underlying channel housed within chute 35 that sits in the opened container 1 and has this same 20 degree slope to prevent the trap door from opening more and trash inside of the container from interfering with the door's movement. Rivets 37, on both sides, fix member 13 to the ends of the gear racks 17 and 19.

Figure 3:
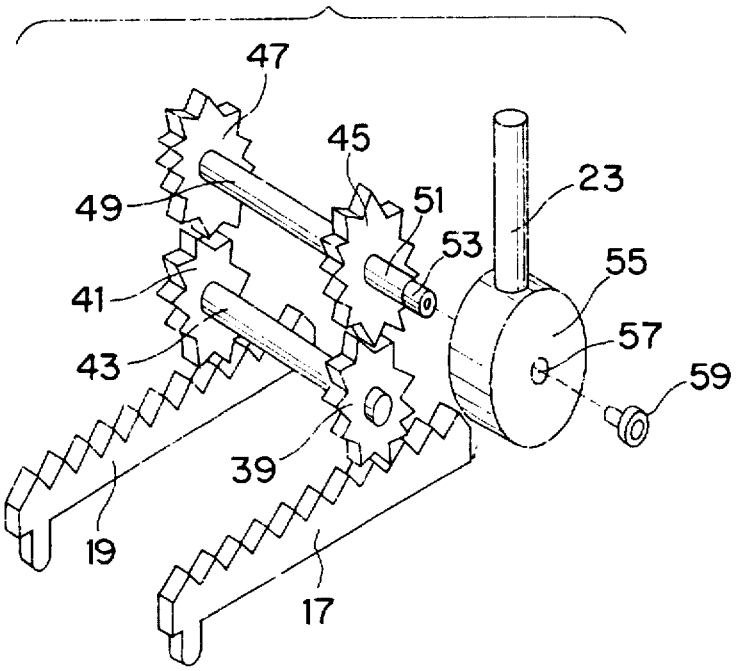
FIG. 3 shows a detailed side perspective view of the gear mechanism used for the can crusher.

FIG. 3 shows a detailed side perspective view of the gear mechanism used for the can crusher. The two spaced linear gear racks 17 and 19 are fixed to the movable rear member 13 and the teeth of the two spur type secondary drive gears 39 and 41. A cross axle 43 connects these two gears to insure their unison rotation. Located above the secondary drive gears and two primary drive gears 45 and 47 which mesh with the lower gears as shown. An interconnection axle 49 between the two primary drive gears 45 and 47 insures their movement in unison. All of these gears except of the gear racks are housed within housing 21.

At the end of the axle 49 there is an extension 51 having a hole with an internally threaded end 53. The lower rounded enlarged handle end 55 has an internal cavity which fits over the extension 51 and an end smaller opening 57. A screw 59 with and enlarged head and external threads that complements those of the hole's threads 53 fits through hole 57 to mount the handle 23 to the gear axle 49. As the handle is pushed down the two sets of connected gears rotate to move the gear racks 17 and 19 with the movable element 13 towards the stationary anvil element 11.

At the same time the two lower door cams 29 move in the same direction as the rack gears 17 and 19. At first these cams bear against the trap door to open it as the gear racks move to the right. However, when the cams reach the sloped linear side cams 61 (see FIG. 2) the gear racks are gradually elevated and the lower trap door starts to open more against the action of its biasing spring. While this takes place the movable element 13, bearing against and crushes the can while the now slightly raised element 13 pushes down on the can in the process forcing it into the fully opened trap door where it falls through to a chute below.

Figure 4:
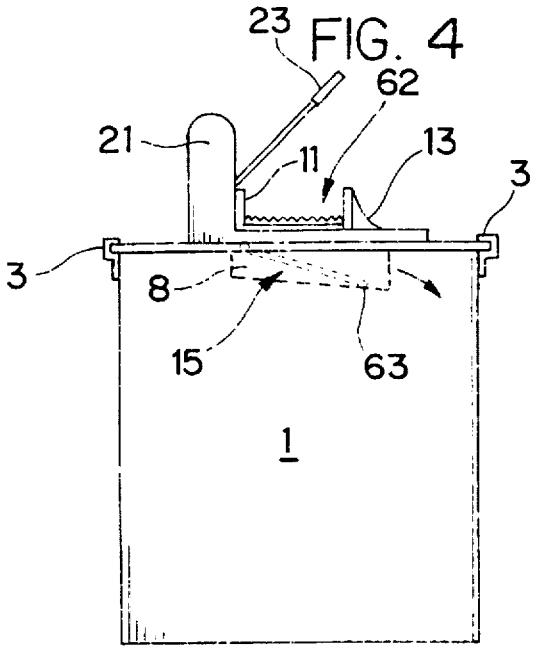
FIG. 4 shows a detailed side sectional view of the container and how the crushed cans are deposited.

FIG. 4 shows a detailed side sectional view of the container 1 and how the crushed cans 62 are deposited into it. The gearing has been omitted to simplify the explanation. As movable vice element 13 moves towards fixed stationary vice anvil 11 by operating handle 23, trap door 15 is forced opened against its closing return spring 33. The crushed can is both forced by the slightly elevated element 13 and gravity to fall down into the opened trap door 15. Below the trap door a box type sloped protective chute 63, shown by dotted lines, located internally of member 35 prevents the trap door from further opening and permits the now crushed can 62 to exit from it to the lower container. This chute also prevents trash within the container from coming into contact with the trap door whether closed or opened. When the handle 23 is retracted to its upright position, as shown in FIG. 2, the lower door opening cams 29 are no longer functioning to open the trap door and the door spring 33 returns the door to its normally closed position.

Many of the primary components of the can crusher including its frame, internal gears, slides, trap door, angled chute, side clamps and handle would best be manufactured of automobile grade ABS (Acrylonitrile-butadiene-styrene) plastic material using the plastic injection molding process. Injection molding is a plastic molding process whereby heat softened plastic material is forced under very high pressure into a metal cavity mold, usually aluminum or steel, which is relatively cool. The inside cavity of the mold is comprised of two or more halves, and is the same desired shape as the product to be formed (in this case the listed components).

High pressure hydraulics are used to keep the mold components together during the actual injection phase of the molding process. The injected plastic is allowed to cool and harden in the mold. The hydraulics holding the multiple component mold cavity together are released, the mold halves are separated and the solid formed plastic item is removed. Injection molding can be highly automated process and is capable of producing extremely detailed parts at a very cost effective price. The process should be invaluable in producing this invention's can crusher cost effectively.

The two linear gear racks and crushing vice jaw surfaces are best manufactured using conventional metal stamping and punching techniques. Metal stamping is a process whereby flat metal is formed between two parts of a die under tremendous pressure. The metal can be punched, formed and shaped in these dies, many times in one process, and spot welding of separate components can be employed to complete the assembly of sheet metal components. The stamped metal may be stainless steel or plated carbon steel to prevent rusting. The metal punching process involves a male and female die, both are which are machined into the shape of the desired finished product. The dies are made of hardened tool steel, and are placed in the jaws of a hydraulic press. In operation, the steel material to be punched is placed between the two die components and the hydraulic press activated. The two dies quickly "punch out" the desired shape from the sheet metal, producing the desired metal component.

The biasing spring 33 for the trap door to keep it normally closed is available as an "off the shelf" item. The Thomas Register of American Manufacturers is a good source to consult for locating suppliers for this component.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A can crusher adapted to be mounted on a container comprising:

a vice having a stationary anvil element and a movable member between which the can to be crushed can be placed;

a normally closed trap door located below said vice and above the container for receiving crushed cans; and means for opening said trap door as a can is processed for crushing, said means including a manually operated pivotally connected handle, a pair of gear racks fixed to said vice's movable member and interconnecting gear members between the gear racks and the handle to permit linear movement of the racks by depressing the handle.

2. The invention as claimed in claim 1, wherein said gear racks have lower camming surfaces which act to open the trap door as the racks are moved towards the stationary anvil element.

3. The invention as claimed in claim 2, wherein said trap door is normally maintained closed by a biasing spring.

4. The invention as claimed in claim 3, also including a lower protective chute into which the crushed cans are deposited, said chute being mounted in the upper portion of the container.

* * * * *